US005406364A

United States Patent [19]

Maeyama et al.

[11] Patent Number: 5,406,364

[45] Date of Patent: Apr. 11, 1995

[54] ELECTROPHOTOGRAPHIC APPARATUS CLEANING MEMBER AND ELECTROPHOTOGRAPHIC APPARATUS USING THE CLEANING MEMBER

[75] Inventors: Ryuichiro Maeyama, Yokohama; Tatsuo Takeuchi, Kawasaki; Masahiro Inoue, Yokohama; Takahiro Kubo, Tokyo; Yasuo Nami, Kawasaki, all of Japan

[73] Assignee: Canon Kabushiki Kaisha, Tokyo, Japan

[21] Appl. No.: 119,969

[22] Filed: Sep. 13, 1993

[30] Foreign Application Priority Data

Sep. 14, 1992 [JP] Japan ..... 4-269095

[51] Int. Cl.[6] ..... G03G 21/00

[52] U.S. Cl. ..... 355/296; 355/284

[58] Field of Search ..... 355/296, 283, 284

[56] References Cited

U.S. PATENT DOCUMENTS

| | | | |
|---|---|---|---|
| 3,776,631 | 12/1973 | Mammino | 355/296 |
| 4,541,707 | 9/1985 | Yoshinaga | 355/284 |
| 5,021,834 | 6/1991 | Tsuruoka et al. | 355/296 Y |
| 5,132,739 | 7/1992 | Mauer et al. | 355/284 |

FOREIGN PATENT DOCUMENTS 55-166672 12/1980 Japan .

*Primary Examiner*—Joan H. Pendegrass

*Attorney, Agent, or Firm*—Fitzpatrick, Cella, Harper & Scinto

[57] ABSTRACT

A cleaning member carrying porous particles for absorbing a parting agent is used in an electrophotographic apparatus having a fixation unit in which a developer image transferred to a transfer member is fixed by a fixation rotary member to which the parting agent is applied, and means for forming an image on two surfaces of the transfer member.

13 Claims, 3 Drawing Sheets

ELECTROPHOTOGRAPHIC APPARATUS CLEANING MEMBER AND ELECTROPHOTOGRAPHIC APPARATUS USING THE CLEANING MEMBER

BACKGROUND OF THE INVENTION

1. Field of the Invention

This invention relates to a cleaning member for removing a residual parting agent attached to a photosensitive member, a transfer carrier member, a member disposed along a transport path, a transfer member after fixation provided in an electrophotographic apparatus and also relates to an electrophotographic apparatus using the cleaning member.

2. Description of the Related Art

Various kinds of electrophotographic apparatuses in which a toner image on an image carrier member such as a photosensitive member or an insulating member is transferred to a transfer member by making the transfer member face the image carrier member one or a number of times to obtain a monochromatic or color image, e.g., electrophotographic copying machines and printers, have been proposed and put on the market. A cleaning member for such electrophotographic apparatuses, i.e., for removing residual silicone oil attached to an image carrier, transfer member carrier member, such as a transfer drum, a member disposed along a transport path, a transfer member after fixation is formed of, for example, a cloth-like member impregnated with a dispersion liquid of a polishing material, which is a cleaning member for an electrophotographic member disclosed in Japanese Patent Laid-Open Publication No.55-166672.

FIG. 2 shows an example of a color electrophotographic copying machine for forming a full color image. In the color electrophotographic copying machine, as illustrated, an electrophotographic photosensitive member in the form of a drum provided as an image carrier, i.e., a photosensitive drum 1 is supported so as to be rotatable in the direction of the arrow, and a corona charging unit 2, an exposure optical system 3, a development unit 4, a transfer unit 5 and a cleaner 6 are disposed around the photosensitive drum 1.

The optical system 3 has an original scanning unit 3*a* and a color decomposition filter 3*b*. By the optical system 3, the photosensitive drum 1 uniformly charged by the charging unit 2 is irradiated with an image light of each of the color-decomposed images to form a latent image. The development unit 4 of a rotary type has four development devices, i.e., a yellow development device 4Y, a magenta development device 4M, a cyan development device 4C and a black development device 4B disposed about a center axis 4*b*. Each development device is rotated to a predetermined position such as to face the photosensitive drum 1 to form a toner image on the photosensitive drum 1 by developing the corresponding latent image on the photosensitive drum 1.

The toner image formed on the photosensitive drum 1 is transferred to a transfer member which is supplied from a transfer member cassette 7 through a transport system and the transfer unit 5 and set in a position such as to face the photosensitive drum 1. The transfer unit 5 has a cylinder 5*a*, a transfer charging device 5*b*, a transfer member gripper 5*c* for holding and transporting a transfer member, an inner charging device 5*d*, and an outer charging device 5*e*. A transfer member carrying sheet 5*f* formed of a dielectric material is stretched cylindrically on a circumferential surface opening region of the cylinder 5*a*.

As the above-described drum-like transfer unit (transfer drum) 5 is rotated, the toner image on the photosensitive drum 1 is transferred to a transfer member carried by the transfer member carrying sheet 5*f* by the transfer member charging device 5*b*. The transfer member is attracted to the transfer member carrying sheet 5*f*. Residual toner on the photosensitive drum 1 is removed by the cleaner 6 and is successively used for the next cycle of the image formation process.

In this manner, the desired number of color images are transferred to the transfer member transported while being attracted to the transfer member carrying sheet 5*f*. This color image formation method is well known to those skilled in the art and will not be described in more detail.

When transfer of four-color toner images is completed, the transfer member is separated from the transfer drum 5, processed by a hot roller fixation device 9, and discharged onto a tray 10.

In the color electrophotographic copying machine described above, the transfer carrier member for holding a transfer member, i.e., transfer member carrying sheet 5*f* formed of a dielectric material, is stretched over a circumferential surface opening of the transfer drum 5. In the vicinity of the circumferential surface of the transfer drum 5, however, the other units, i.e., the photosensitive drum 1, the development unit 4 and the cleaner 6, which carry or contain a developer (toner) are disposed. It is possible that unnecessary toner scattered from these units will attach to and contaminate the transfer member carrying sheet on the transfer drum 5. Also, when the transfer member is separated from the transfer drum 5 before toner image is fixed after the transfer of the toner image to the transfer member, toner on the transfer member attaches to the transfer member carrying sheet 5*f* and seriously contaminates the same if transfer member jamming occurs (if the transfer member clogs in the mechanism).

Therefore, a transfer member carrying sheet cleaner, i.e., a cleaning means 11 is provided on the transfer unit 5 for the purpose of removing toner attached to the transfer sheet carrying sheet 5*f*. Ordinarily, cleaning of the transfer member carrying sheet 5*f* is performed during pre-rotation of the transfer drum 5 effected before transfer. However, it is performed any time after transfer member jamming or the like as described above.

The transfer member carrying sheet cleaner 11 is constructed in such a manner that, as shown in FIG. 2, a fur brush cleaner 11*a* is disposed outside the transfer member carrying sheet 5*f* cylindrically stretched over the peripheral surface opening of the cylinder 5*a* to serve as a means for supporting the transfer member carrying sheet, while a backup brush 11*b* is disposed inside the transfer member carrying sheet 5*f*.

The above-described conventional copying machine, however, entails a problem in that a parting agent such as a silicone oil attached to a transfer paper sheet after fixation attaches to a feed roller, a sheet transport means, the transfer drum and the photosensitive drum to obstruct image formation process, if the transfer sheet on which an image has been fixed is fed again to complete two-surface image formation. In particular, if silicone oil is attached to the photosensitive drum, a phenomenon called oil fog occurs. The mechanism causing this problem will be described with reference to FIGS. 3 to 5.

FIG. 3 shows a state of transfer of a part of silicone oil existing on fixed toner to the transfer drum.

FIG. 4 shows a state of transfer of transferred silicone oil existing on the transfer drum to the photosensitive drum through a nip during post-rotation.

FIG. 5 shows a state in which transferred silicone oil transferred to the photosensitive drum adhesively collects toner existing around the photosensitive drum and is transferred at the time of the next transfer to cause fogging.

For prevention of such a phenomenon, it is necessary to rapidly remove transferred silicone oil. However, the above-described cloth-like member impregnated with a dispersion liquid of a polishing material or a cloth-like member simply formed of a nonwoven fabric is incapable of removing transferred oil and only spreads the oil as a film on the surface to be cleaned. Also, silicone oil cannot be removed by the fur brush.

SUMMARY OF THE INVENTION

An object of the present invention is to provide a cleaning member capable of rapidly removing a parting agent such as silicone oil.

Another object of the present invention is to provide an electrophotographic apparatus using such a cleaning member.

To achieve these objects, according to the present invention, there is provided a cleaning member comprising particles for absorbing a parting agent.

A parting agent attached to a transfer member carrying 10 member such as a transfer belt or a photosensitive member such as a photosensitive drum or a photosensitive sheet can be rapidly removed by being absorbed by particles carried by the cleaning member. That is, the particle surfaces have a finely-porous structure, and the parting agent can be rapidly absorbed in the particles by capillarity of the porous structure. Therefore, the parting agent can be removed by the particles of the present invention more rapidly than by, for example, a sponge.

DESCRIPTION F THE PREFERRED EMBODIMENT

Porous particles are preferably used as particles for absorbing a parting agent carried on a cleaning member in accordance with the present invention. The material of the porous particles may be a colloidal metallic oxide, such as colloidal alumina, colloidal silica, colloidal titania, or colloidal zirconia. This material is prepared in a sol state in a dispersion medium which is water or an organic solvent, and this sol is applied to a suitable member such as cloth, a roll, or a blade and is dried to form colloidal particles. A cleaning member is obtained in this manner. Colloidal particles are porous particles of alumina hydrate, silica hydrate or the like unlike alumina or silica formed by firing. Colloidal alumina is particularly preferred as such colloidal particles. Colloidal alumina is alumina hydrate and is carried in such a manner that a cloth-like member or the like is impregnated with a colloidal solution of alumina hydrate having water as a dispersion medium. The parting agent absorbing ability of the cleaning member is thereby remarkably improved and the cleaning member is enabled to instantly absorb a parting agent. Accordingly, transferred oil can be rapidly removed by the cleaning member.

Preferably, a boehmite alumina sol is used as the alumina hydrate colloidal solution having water as a dispersion medium.

The parting agent is a compound applied to a rotary member to prevent attachment of a toner to the rotary member, when a toner image is fixed by heating and pressing with the rotary member. Oil, such as silicone oil, ester oil, liquid polyether, spindle oil, machine oil, cylinder oil or the like, is used as the parting agent. The parting agent may be supplied from an oil tank to the rotary member or may be supplied by being contained in toner particles. The cleaning member is placed in a position such as to be able to remove the parting agent. Ordinarily, the cleaning member is disposed in combination with a transfer member carrying member, such as a transfer drum or a transfer belt, or a photosensitive member, such as a photosensitive drum or a photosensitive sheet, so as to be able to contact such a member, or the cleaning member is disposed on both the transfer member carrying member and the photosensitive member.

Embodiment 1

Figure 1:
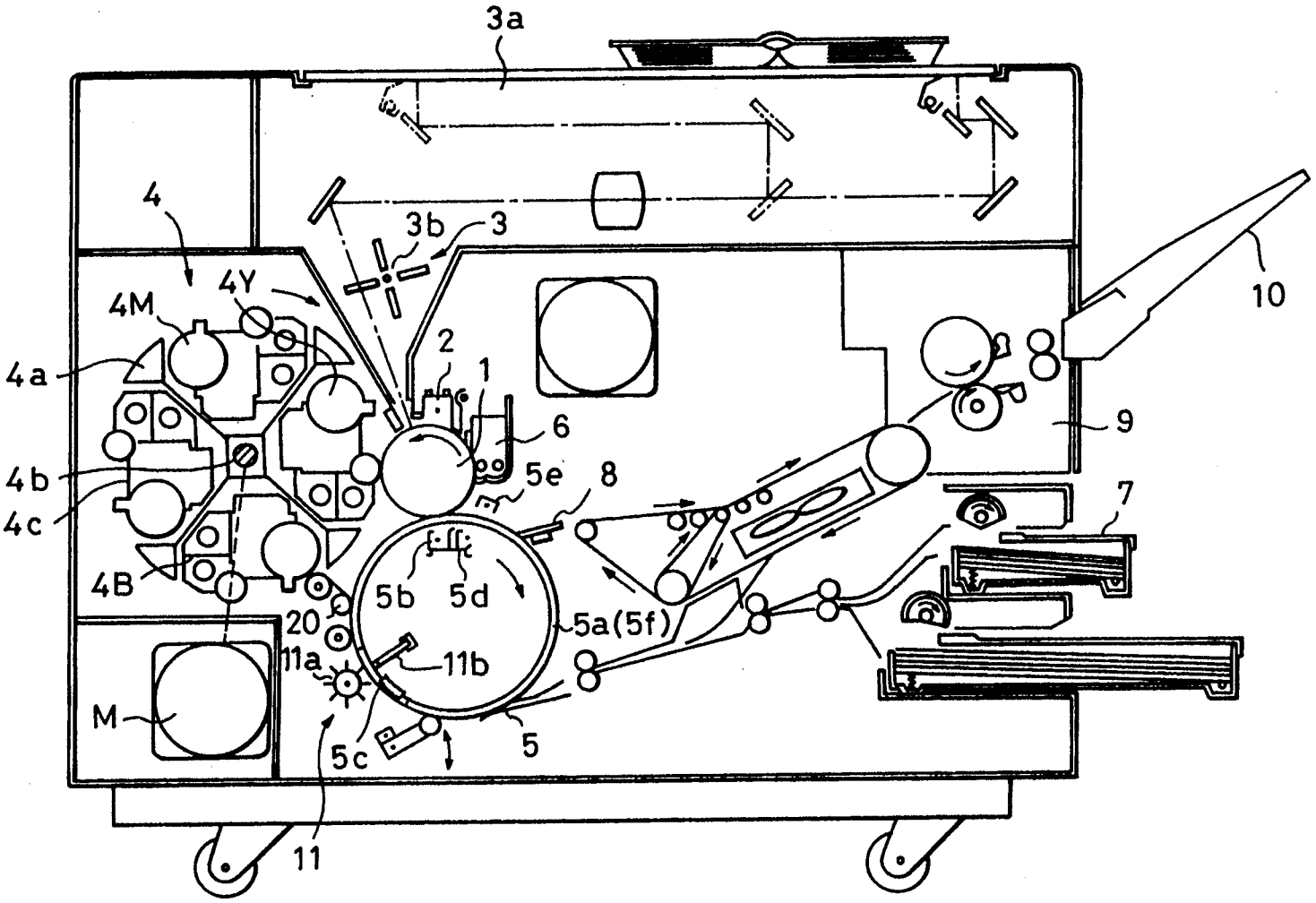
FIG. 1 is a schematic cross-sectional view of an electrophotographic apparatus having a cleaning member in accordance with an embodiment of the present invention.
Figure 2:
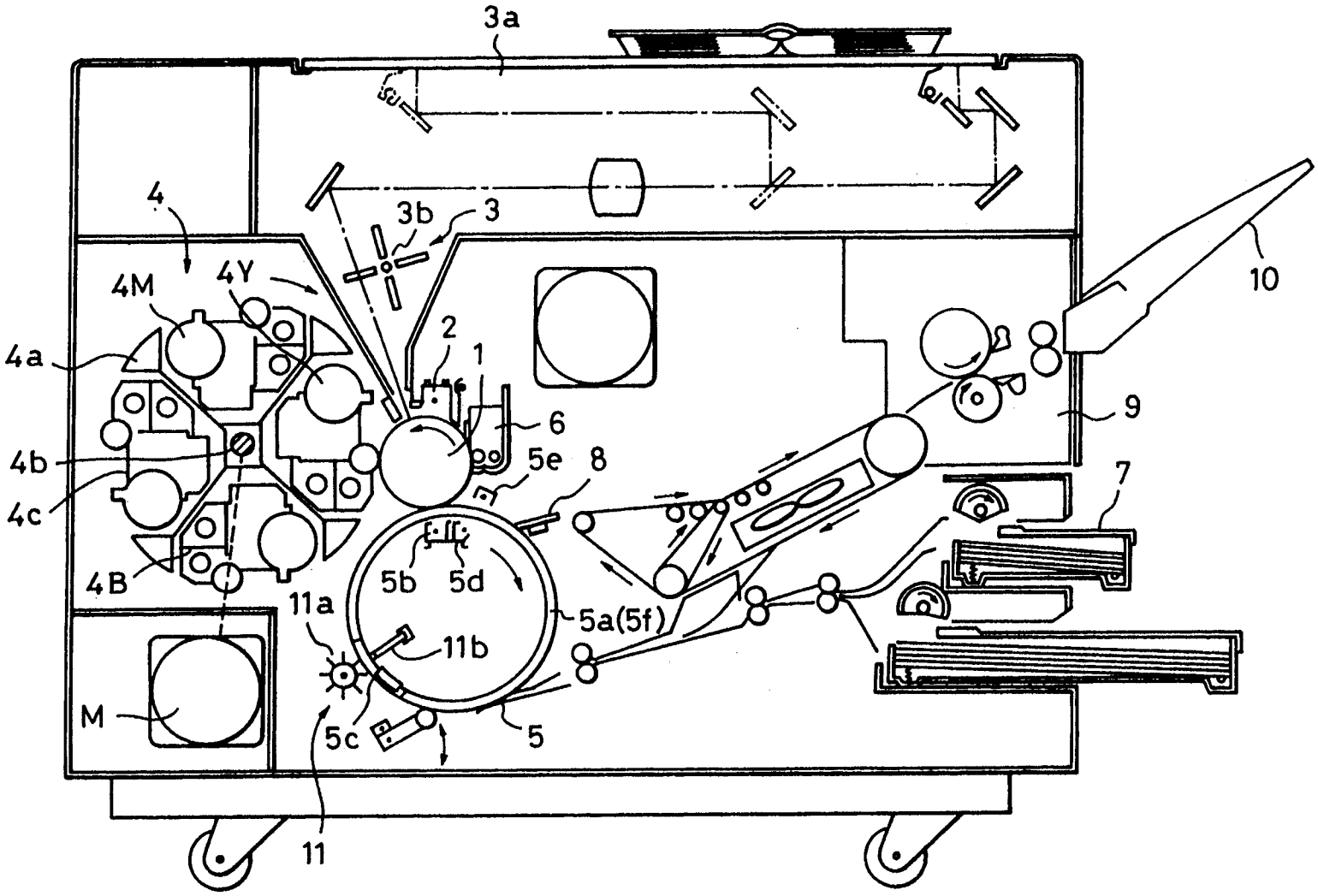
FIG. 2 is a schematic cross-sectional view of an electrophotographic apparatus having a conventional cleaning means.
Figure 3:
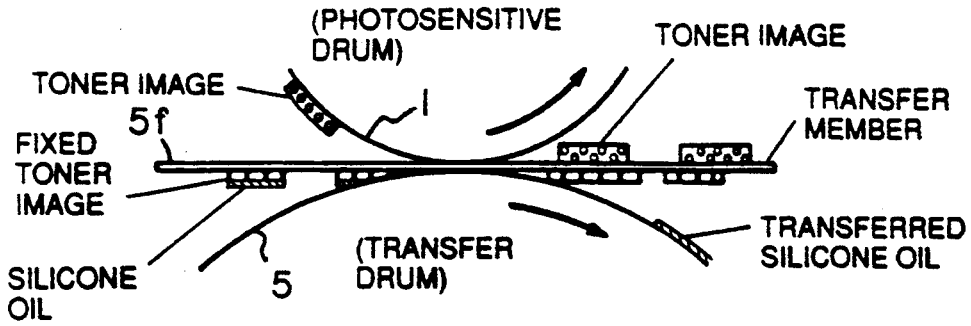
FIG. 3 is a diagram showing a mechanism of transfer of a parting agent from a transfer member to a transfer drum during two-surface transfer in the apparatus shown in FIG. 2.
Figure 4:
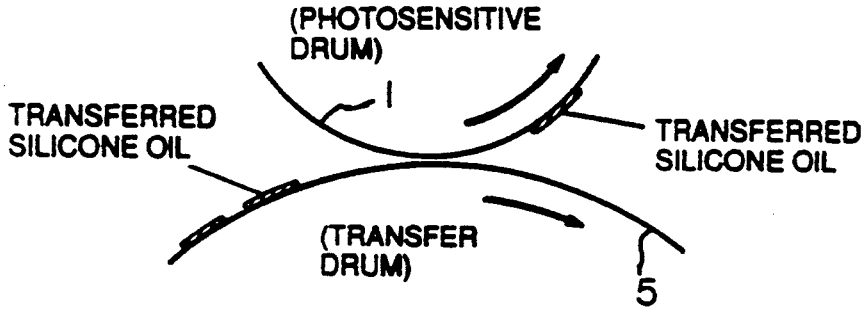
FIG. 4 is a diagram showing a mechanism of transfer of the parting agent from the transfer member to the transfer drum during post-rotation of the transfer drum in the apparatus shown in FIG. 2.
Figure 5:
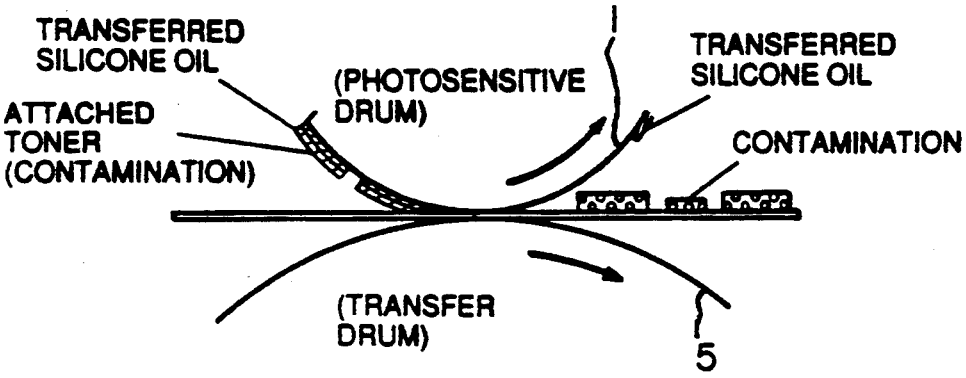
FIG. 5 is a diagram showing a mechanism of transfer of attached toner to the transfer member during next transfer in the apparatus shown in FIG. 2.

FIG. 1 shows an electrophotographic apparatus having a cleaning member in accordance with an embodiment of the present invention. The construction and the operation of this electrophotographic apparatus is substantially the same as those of the apparatus shown in FIG. 2 except for a cleaning member, and the description for the common components will not be repeated.

Referring to FIG. 1, a transfer drum 5 has a means for supporting a transfer member carrying sheet having a cylindrical shape in this embodiment, i.e., a cylinder 5*a*, a transfer charging device 5*b*, a transfer member gripper 5*c* for holding and transporting a transfer member, an inner charging device 5*d*, and an outer charging device 5*e*. A transfer member carrying member 5*f* (a transfer member carrying sheet 5*f* in this embodiment) formed of a dielectric material is stretched cylindrically on a circumferential surface opening region of the cylinder 5*a*.

A cleaner (cleaning means) 11 for cleaning the transfer member carrying sheet 5*f* cleaning means 11 is provided on the transfer drum 5 for the purpose of removing toner attached to the transfer sheet carrying sheet 5*f*.

Ordinarily, cleaning of the transfer member carrying sheet 5*f* is performed during pre-rotation of the transfer drum 5 effected before transfer. However, it is performed any time if transfer member jamming or the like has occurred.

The transfer member carrying sheet cleaner 11 is constructed in such a manner that a fur brush cleaner 11*a* is disposed outside the transfer member carrying sheet 5*f* stretched over the peripheral surface opening of the cylinder 5*a*, while a backup brush 11*b* is disposed inside the transfer member carrying sheet 5*f*.

Oil transfer/attachment cannot be prevented only by the above-described arrangement at the time of two-surface copying as described above. Therefore, a web cleaner 20 is provided on the transfer drum on the traveling direction upstream side of the transfer position for the purpose of removing oil transferred and attached.

A web for use in the web cleaner 20 was made by a process described below.

A colloidal solution having a 5% solid component and formed of 5 parts of alumina sol (commercial name: "AS-3", a product from Shokubai Kasei) (solid component) and 95 parts of water was prepared. A piece of nonwoven fabric WP-8085 (a product from Japan Vilene) was immersed in this solution until the entire surface was wetted. The wetted fabric piece was dried and cut to obtain the desired web.

The obtained web was evaluated by a method described below. A color copying machine made by Canon Inc. (commercial name: "CLC-500") is used and the amount of silicone oil applied for fixation (commercial name: "KF-96", a product from Shinetsu Kagaku Kogyo), having a viscosity of 300 cs) is regulated to 0.08 g per A4 sheet. The amount of applied oil is measured by supplying 50 sheets of white paper and by measuring the amount of silicone oil per sheet carried by the white paper.

Next, an image is formed on one paper sheet so that the amount of developed toner for single or multiple colors is 1.5 g/A4), and the paper sheet is then reversed. In this manner, the image was successively formed on two surfaces of each of five sheets. After this image forming operation, one white paper sheet having a size of, for example, A3 is passed through the machine, and the cleaning effect is evaluated mainly by observing whether the first color toner is transferred to the white paper when the toner density set to a very small value or zero. Spikes of toner existing on a sleeve of the development device is moved to the photosensitive drum even through no bias is applied, because transferred oil exists on the photosensitive drum. The moved toner is transferred because it has a charge. Accordingly, if there is oil transferred and attached, a fog occurs on the white paper. It is thereby possible to determine whether or not silicone oil is removed.

The first-color toner is mainly transferred because if the first-color toner is attached to oil, a layer of the toner exists as a spacer which hinders attachment of the second and subsequent color toners.

The amount of fog can be recognized with eye with respect to an amount of 0.10 or greater measured with a Macbeth densitometer, and this value was therefore used as a determination criterion.

It was possible to remove silicone oil by using the web made by the above-described process.

Embodiment 2

A web was obtained by the same process as Embodiment 1 except that alumina sol 100 (commercial name, a product from Nissan Kagaku) was used instead of alumina sol AS-3.

It was possible to remove silicone oil by using the web thereby made.

Embodiment 3

Polyvinyl alcohol (commercial name: PVA 17K, a product from Kuraray) previously dissolved in water at a temperature of 97° C. or hither was added to the immersion liquid prepared in Embodiment 1 so that the content of the solid component (colloidal alumina) was 7%, and was dissolved by an agitator at 70 to 100 rpm. A web was immersed in the solution while the solution was maintained at 85° C. or higher.

Except for this, the web was obtained in the same manner as Embodiment 1.

It was possible to remove silicone oil by using the web thereby made.

The web made in the above-described manner may be used by being rolled or by being wrapped around an elastic roll.

It is particularly advantageous to use nonwoven fabric as the cloth-like member since nonwoven fabric is free from the risk of damaging the cleaned member. However, it is also possible to use a soft gauze-like woven fabric.

In the above-described embodiments, web cleaner 20 was provided on the transfer drum. A similar cleaner may be provided on the drum rotation downstream side of a cleaner of the photosensitive drum.

Also, a similar cleaner may be provided at a rear stage of the fixation mechanism to remove silicone oil on the transfer member with a fixed image.

Also, a similar cleaning means may be provided in a sheet feed path or a transport path to remove silicone oil.

In this embodiment, a nonwoven fabric was formed very thinly (about 2 μm thick) in order to improve the effect of adsorption of alumina sol on the nonwoven fabric.

Embodiment 4

A cleaning web was obtained by applying silica gel (Cataloid SI-350, a product from Shokubai Kasei) to a nonwoven fabric instead of alumina sol in the process of Embodiment 1 and drying the applied gel. This web was used in the same manner as Embodiment 1. Silicone oil could be removed thereby. When the obtained web was touched with a finger, a white silica gel powder was attached to the finger.

While the present invention has been described with respect to what presently are considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cleaning member for an electrophotographic apparatus comprising particles for absorbing a parting agent, wherein the particles for absorbing a parting agent are carried on a cloth-like member and comprise colloidal alumina.

2. A cleaning member according to claim 1, wherein the colloidal alumina is a boehmite alumina sol.

3. An electrophotographic apparatus having a fixation unit in which a developer image transferred to a transfer member is fixed by a fixation rotary member to which a parting agent is applied, said apparatus comprising a cleaning member having particles for absorbing the parting agent.

4. An electrophotographic apparatus according to claim 3, wherein said cleaning member comprises a cloth-like member for carrying the particles for absorbing the parting agent.

5. An electrophotographic apparatus according to claim 3, wherein the particles for absorbing the parting agent comprise colloidal alumina.

6. An electrophotographic apparatus according to claim 5, wherein the colloidal alumina is a boehmite alumina sol.

7. An electrophotographic apparatus according to claim 3, wherein said cleaning member is disposed in contact with a surface of a member carrying the transfer member.

8. An electrophotographic apparatus according to claim 3, wherein said cleaning member is disposed in contact with a surface of a photosensitive member on which the developer image is formed.

9. An electrophotographic apparatus according to claim 7 or 8, wherein said cleaning member comprises a cloth-like member for carrying the particles for absorbing the parting agent.

10. An electrophotographic apparatus according to claim 3, wherein the particles for absorbing the parting agent comprise silica gel.

11. An electrophotographic apparatus having a fixation unit in which a developer image transferred to a transfer member is fixed by a fixation rotary member to which a parting agent is applied, and means for forming an image on two surfaces of the transfer member, said apparatus comprising a cleaning member having particles for absorbing the parting agent, said cleaning member having a cloth-like member for carrying the particles for absorbing the parting agent.

12. An electrophotographic apparatus according to claim 11, wherein said cleaning member is disposed in contact with a surface of a member carrying the transfer member.

13. A cleaning member for an electrophotographic apparatus comprising particles for absorbing a parting agent wherein the particles for absorbing the parting agent comprise silica gel.

* * * * *

UNITED STATES PATENT AND TRADEMARK OFFICE

CERTIFICATE OF CORRECTION

PATENT NO. : 5,406,364

DATED : April 11, 1995

INVENTOR(S) : Maeyama et al.

It is certified that error appears in the above-indentified patent and that said Letters Patent is hereby corrected as shown below:

COLUMN 3:

Line 33, "10" should be deleted;
Line 60, "during" should read --during the--; and
Line 62, "F" should read --OF--.

COLUMN 8:

Line 23, "agent" should read --agent,--.

Signed and Sealed this

Fourth Day of July, 1995

Bruce Lehman

*Attest:*

BRUCE LEHMAN

*Attesting Officer*

*Commissioner of Patents and Trademarks*